US007384007B2

(12) United States Patent
Ho

(10) Patent No.: US 7,384,007 B2
(45) Date of Patent: Jun. 10, 2008

(54) SHOWER HEAD STRUCTURE

(76) Inventor: Chin-Hua Ho, No. 151-18, Lane 168, Chang Lu Rd., Changhua City (TW)

( * ) Notice: Subject to any disclaimer, the term of this patent is extended or adjusted under 35 U.S.C. 154(b) by 430 days.

(21) Appl. No.: 11/284,899

(22) Filed: Nov. 23, 2005

(65) Prior Publication Data

US 2007/0113332 A1 May 24, 2007

(51) Int. Cl.
*B05B 1/30* (2006.01)
*B05B 1/14* (2006.01)
*A62C 31/02* (2006.01)

(52) U.S. Cl. ..... 239/570; 239/571; 239/555; 239/589; 239/587.3; 239/553; 239/587.5

(58) Field of Classification Search ..... 239/570, 239/571, 569, 548, 552, 555, 557, 558, 596, 239/559, 589, 590.5, 587.3, 590, 587.4, 587.5, 239/553, 533.9, 600
See application file for complete search history.

(56) References Cited

U.S. PATENT DOCUMENTS 4,588,130 A * 5/1986 Trenary et al. ..... 239/381
5,765,760 A * 6/1998 Kuo ..... 239/440
6,076,743 A * 6/2000 Fan ..... 239/99
6,367,710 B2 * 4/2002 Fan ..... 239/99

* cited by examiner

*Primary Examiner*—Davis D Hwu
(74) *Attorney, Agent, or Firm*—Rabin & Berdo, P.C.

(57) ABSTRACT

A shower head structure includes a front cover disc, a water outlet disc, a joint base, a water stopper body and a water stopper. The shower head body is installed to the joint base, and the water stopper body is connected to the water outlet disc, and the water stopper is installed into the hollow hole of the water stopper body. When water flows into the shower head body, the water pressure pushes the water stopper and the water gasket to block the hollow hole and stop water coming out from outlet disc, but the water will come out from the periphery of the water stopper body instead. If an accessory is installed, the water stopper is pushed to interconnect a passage, so that the water will be supplied to the accessory from the middle of the front cover disc to produce a variety of splashes.

2 Claims, 15 Drawing Sheets

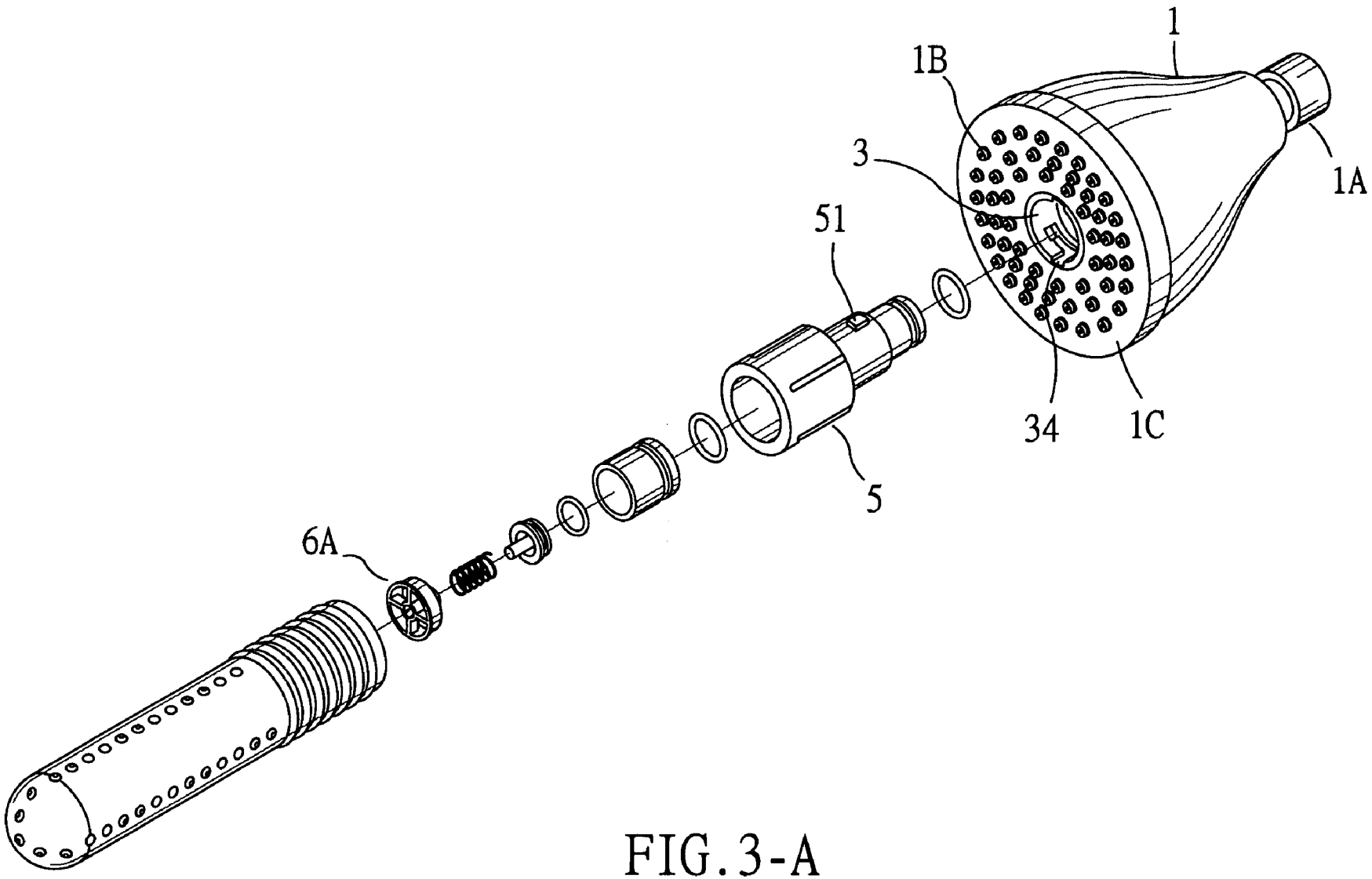
FIG. 3-A

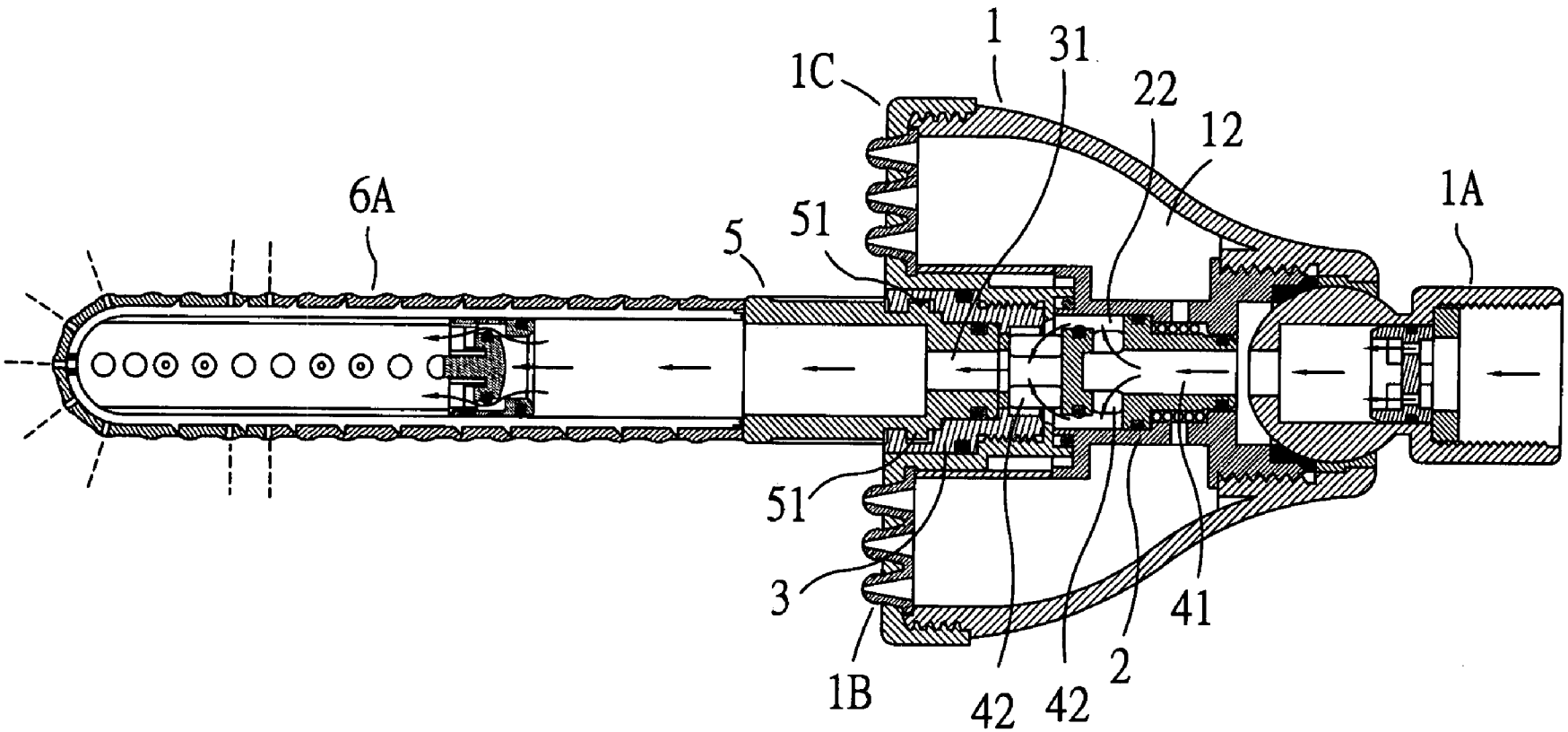
FIG.3-B

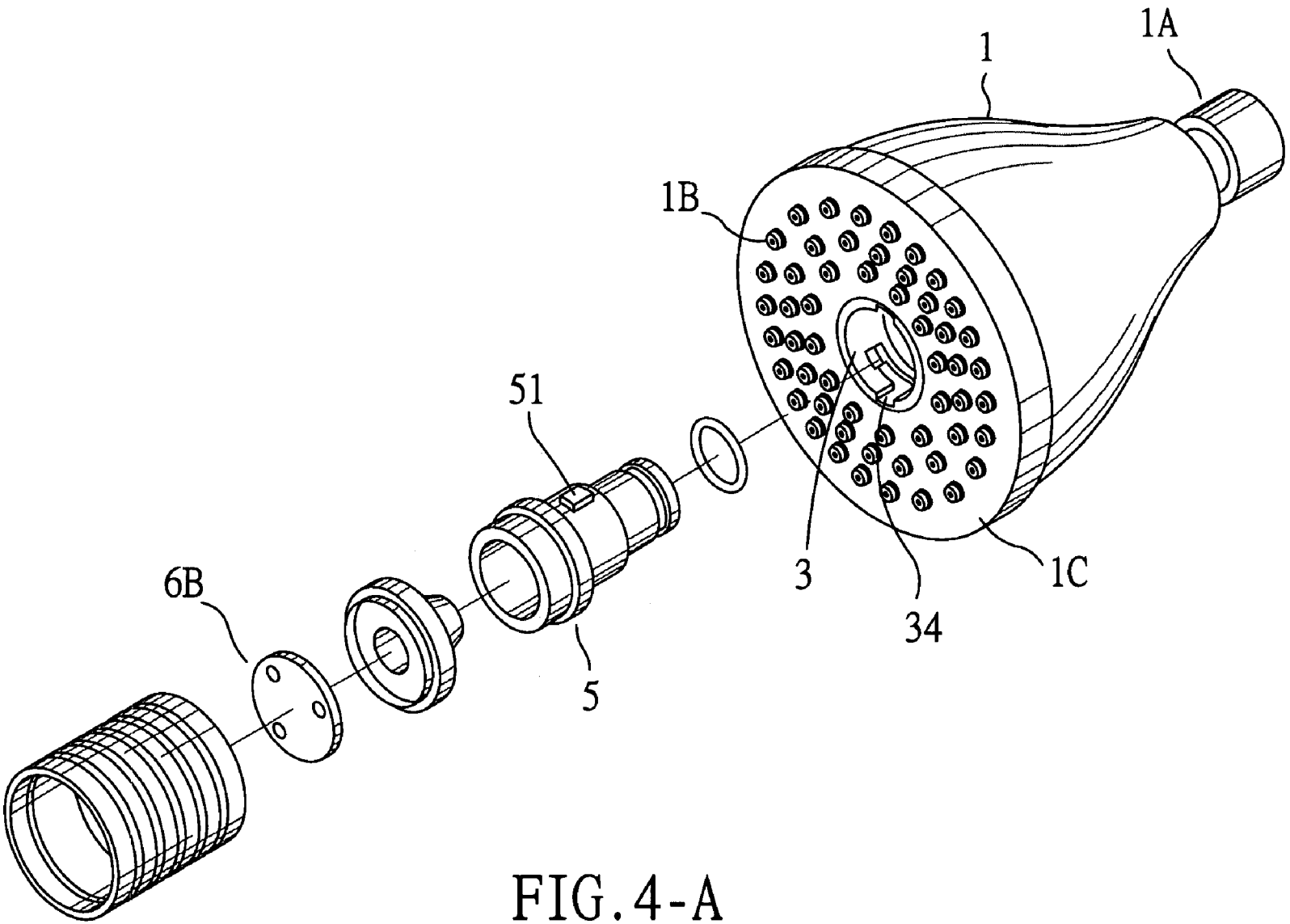
FIG. 4-A

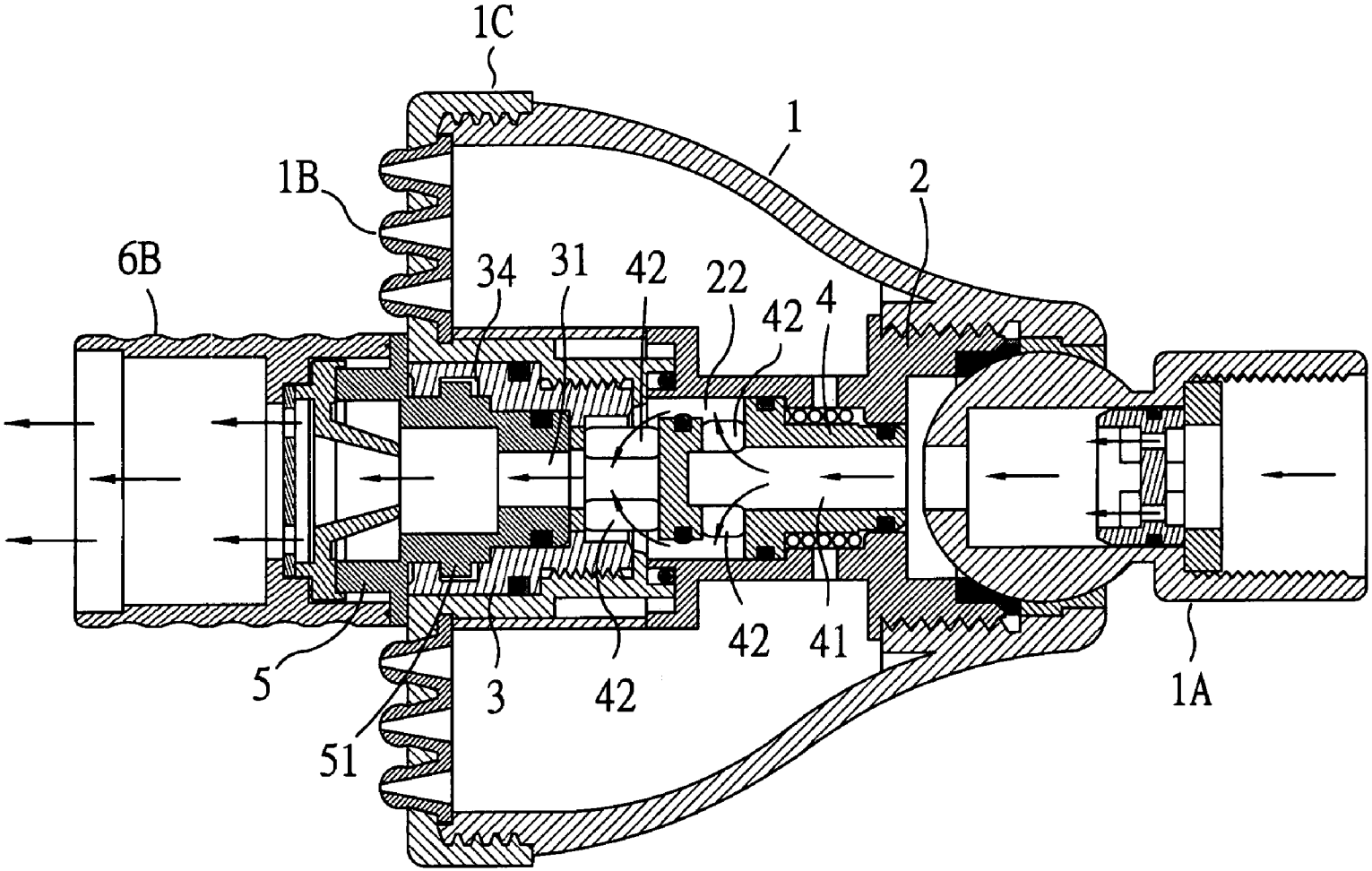
FIG. 4-B

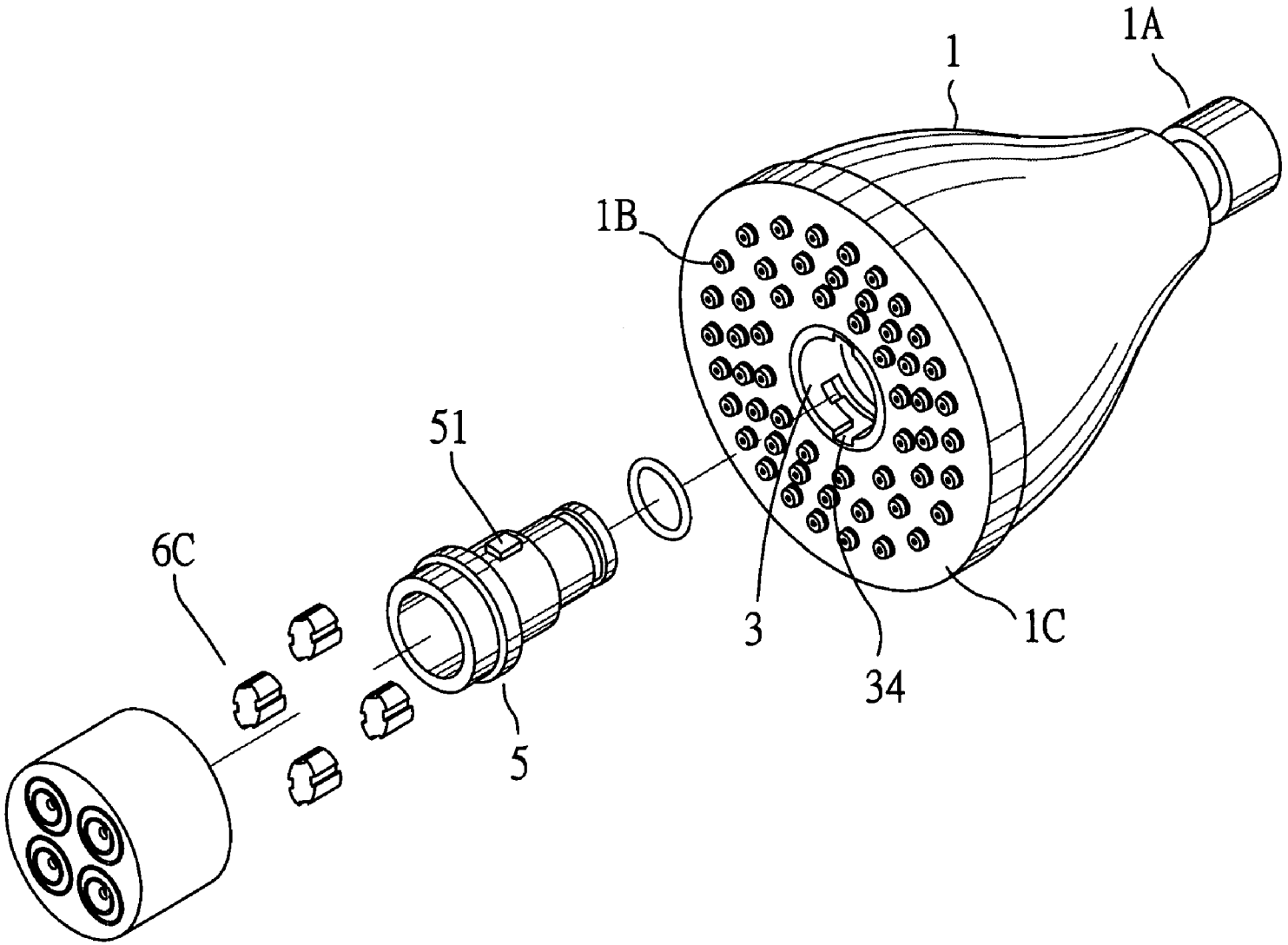
FIG. 5-A

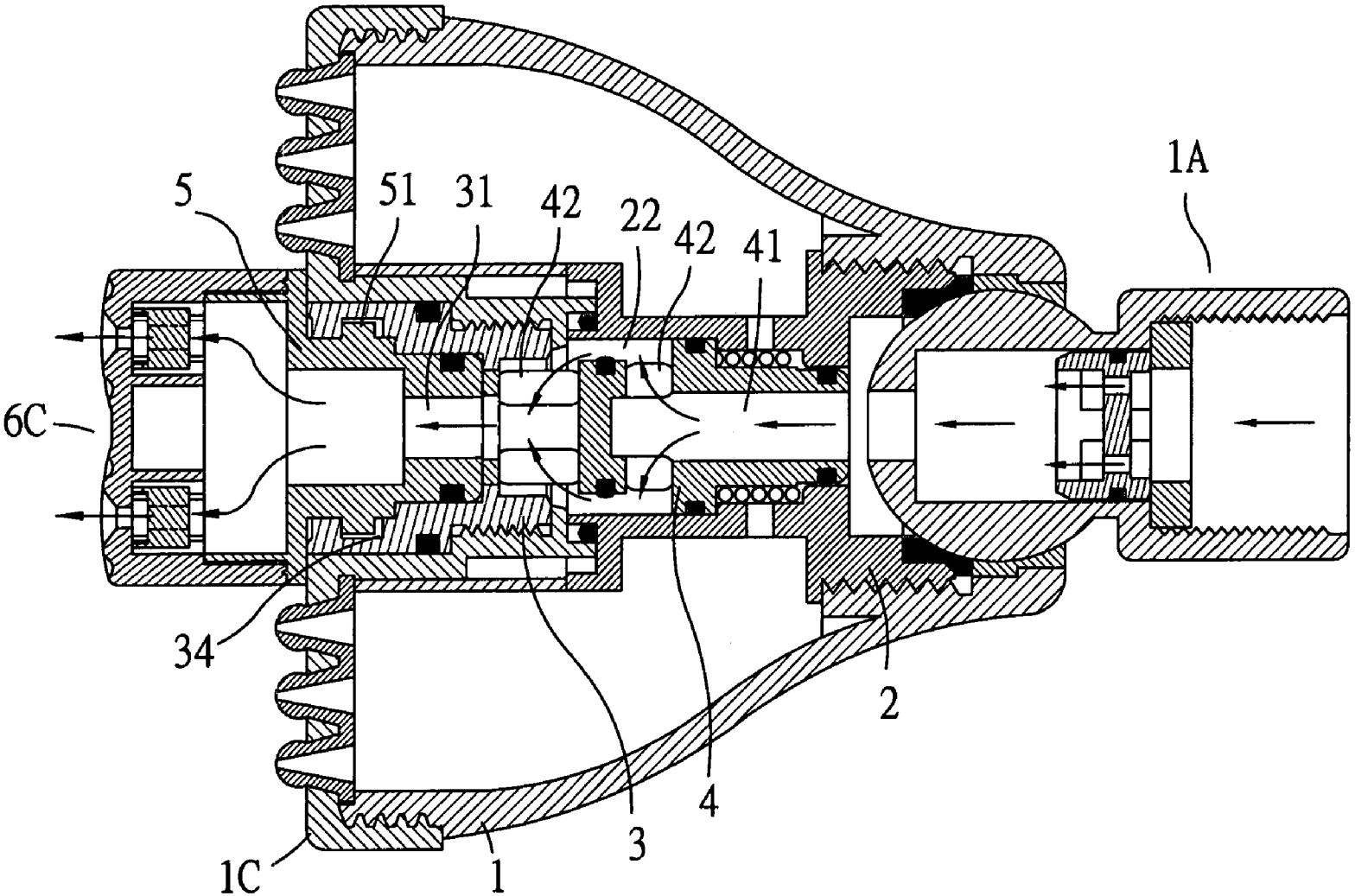
FIG. 5-B

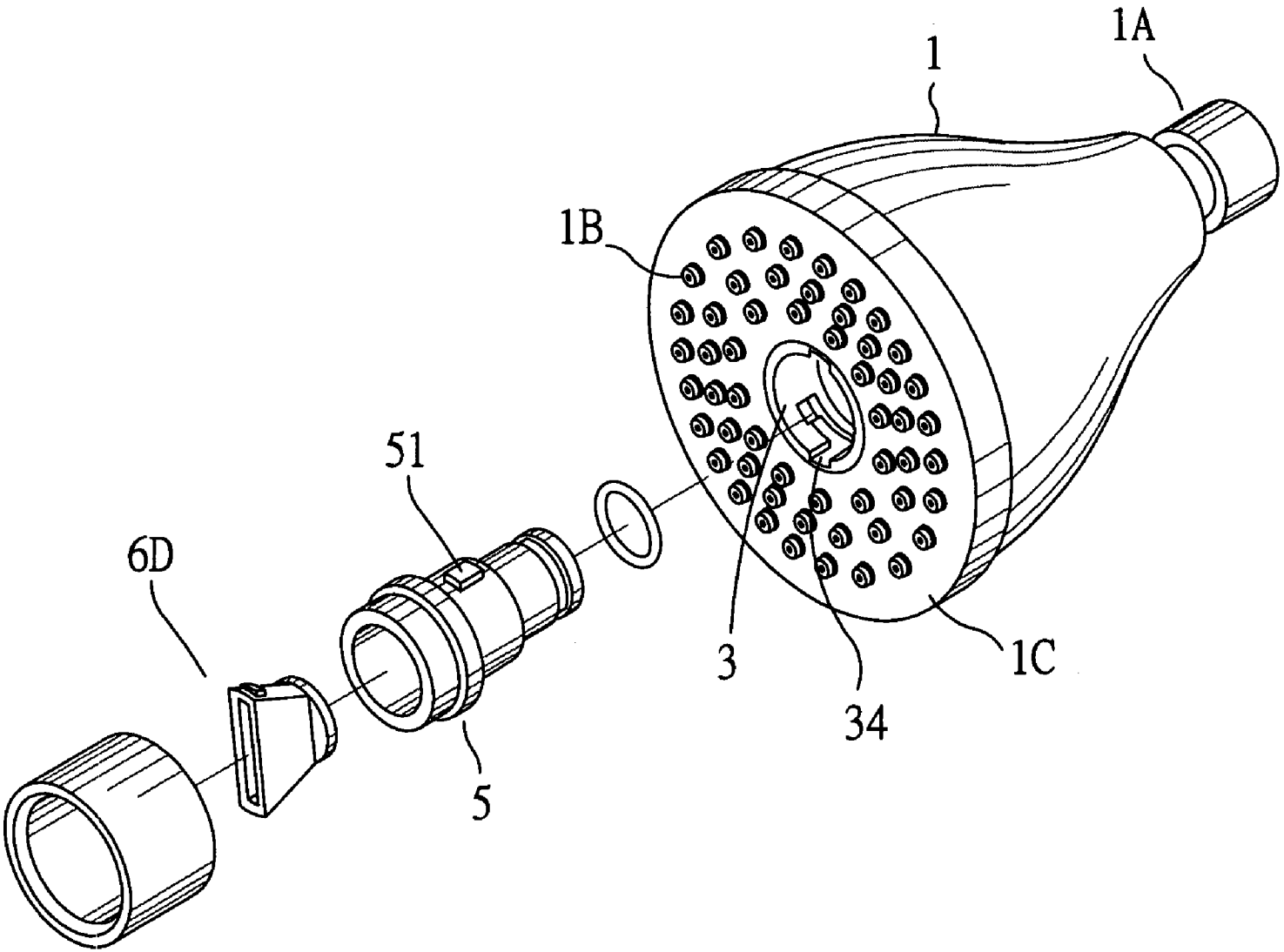
FIG. 6-A

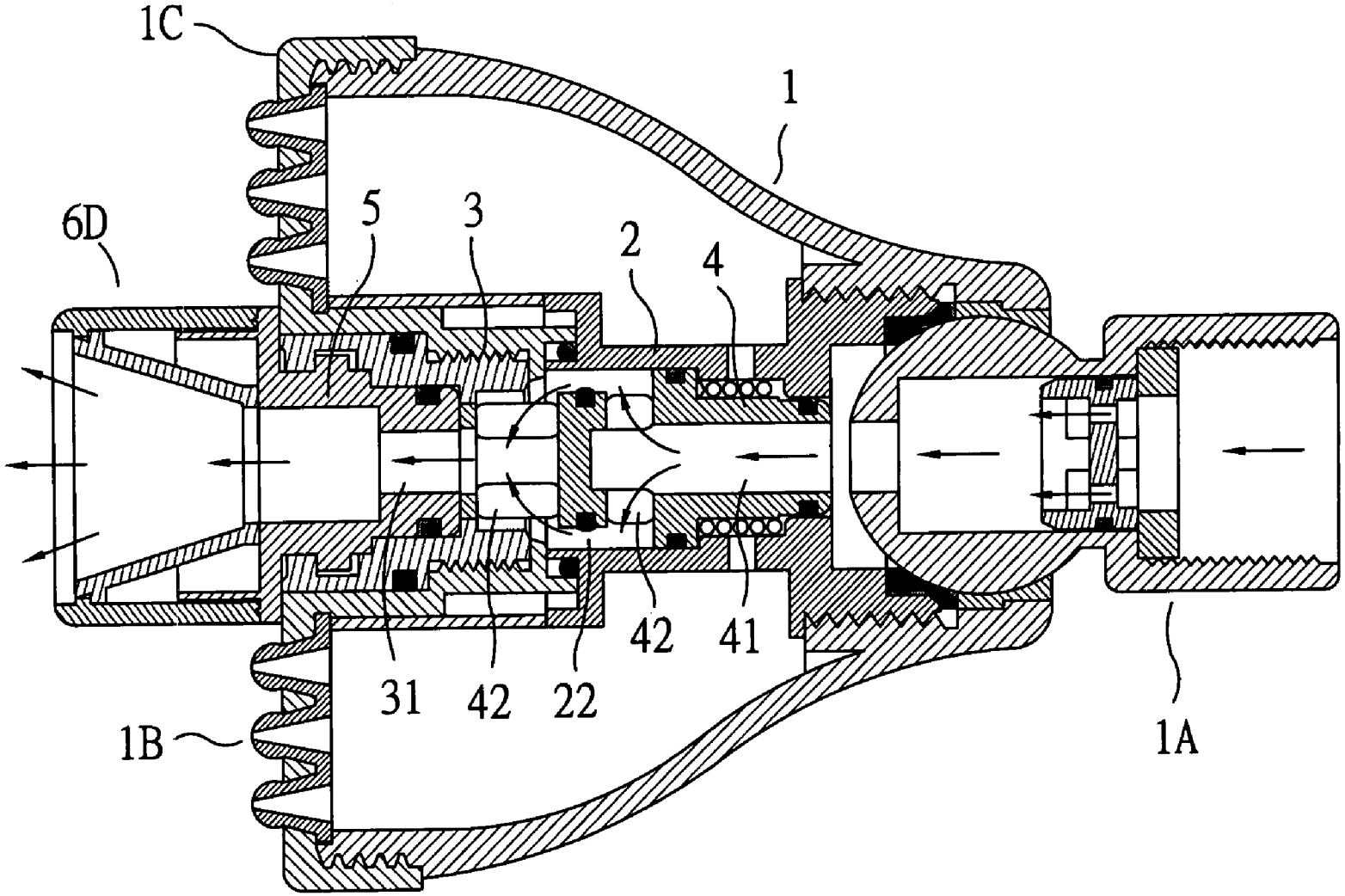
FIG.6-B

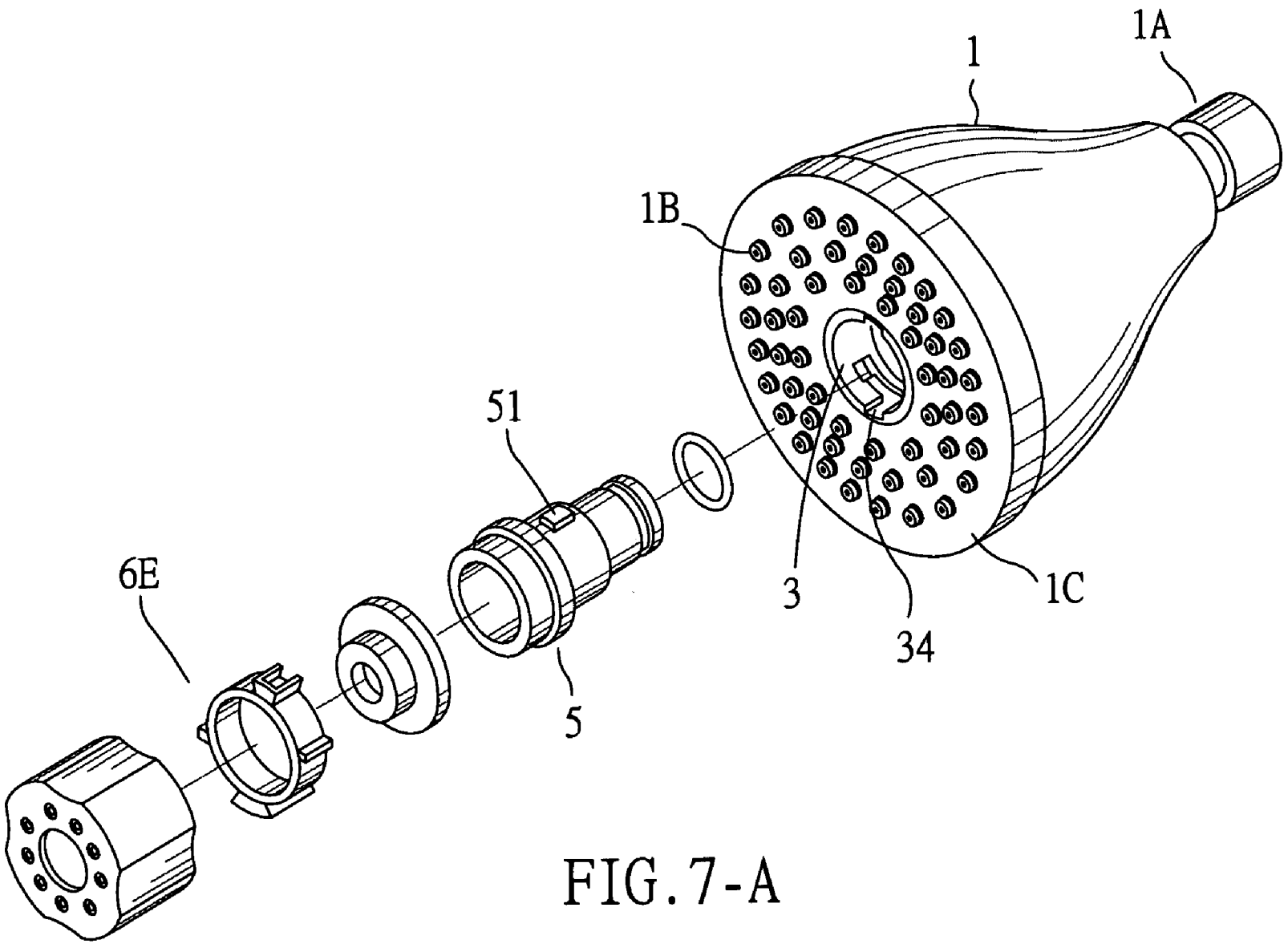
FIG. 7-A

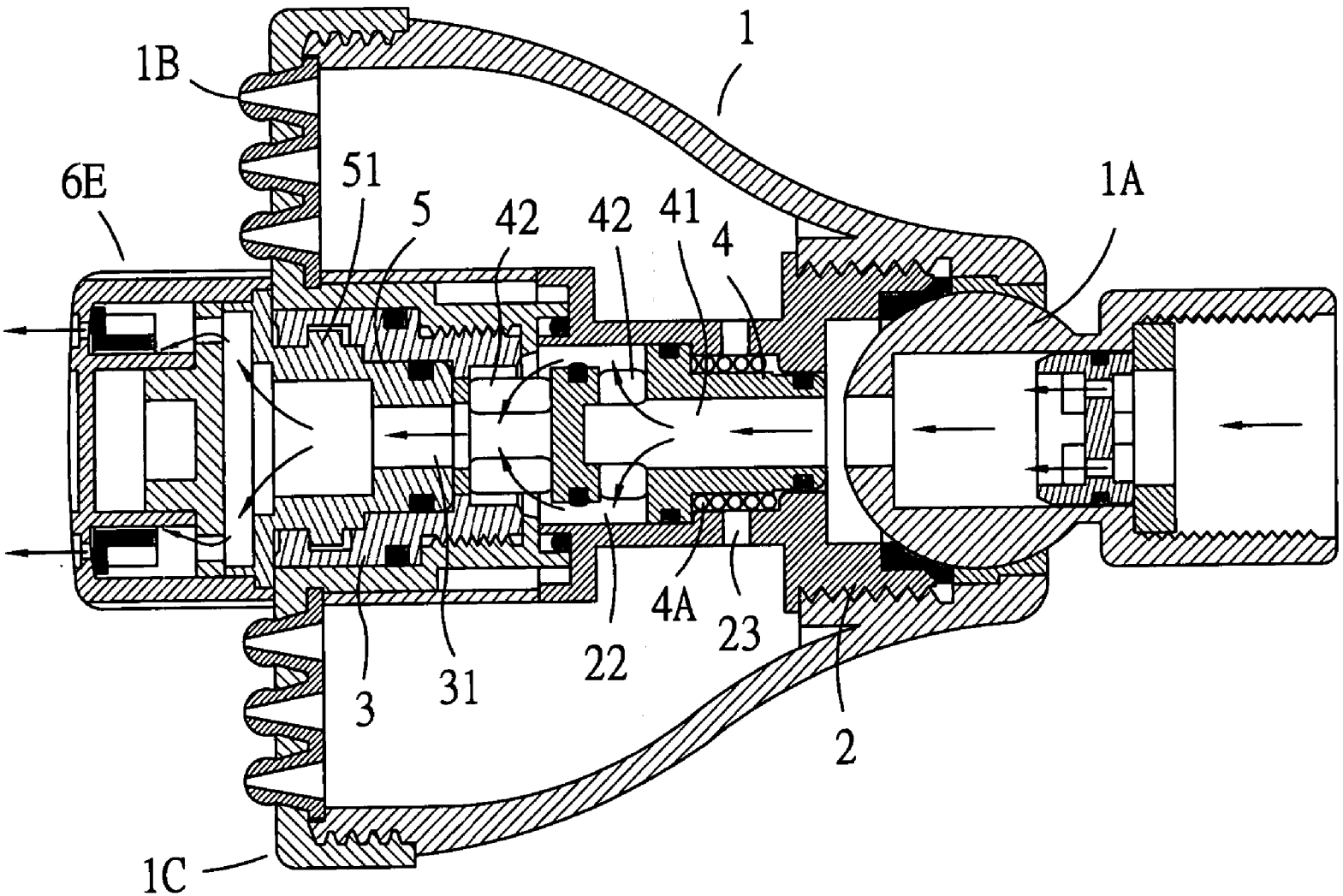
FIG. 7-B

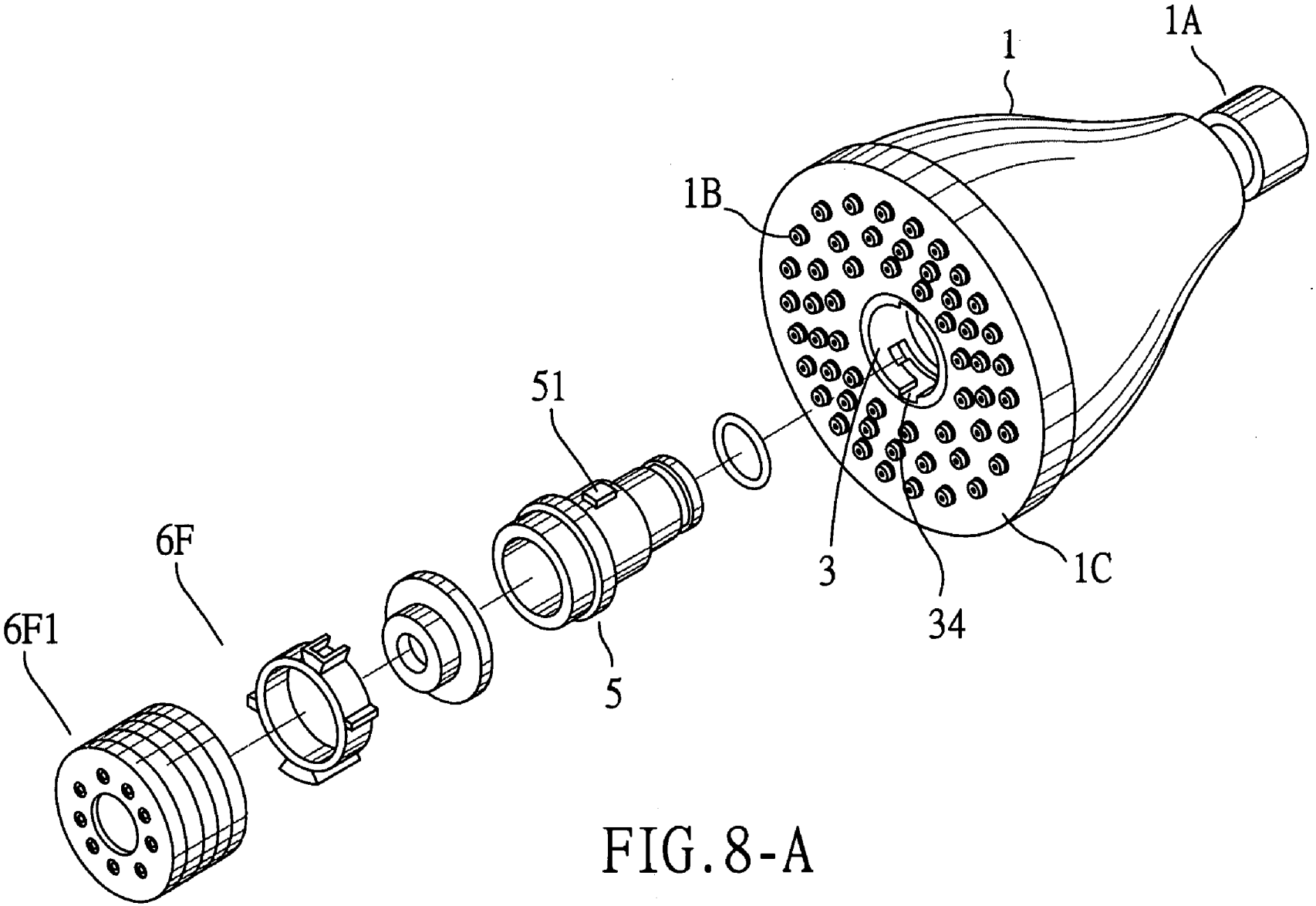
FIG. 8-A

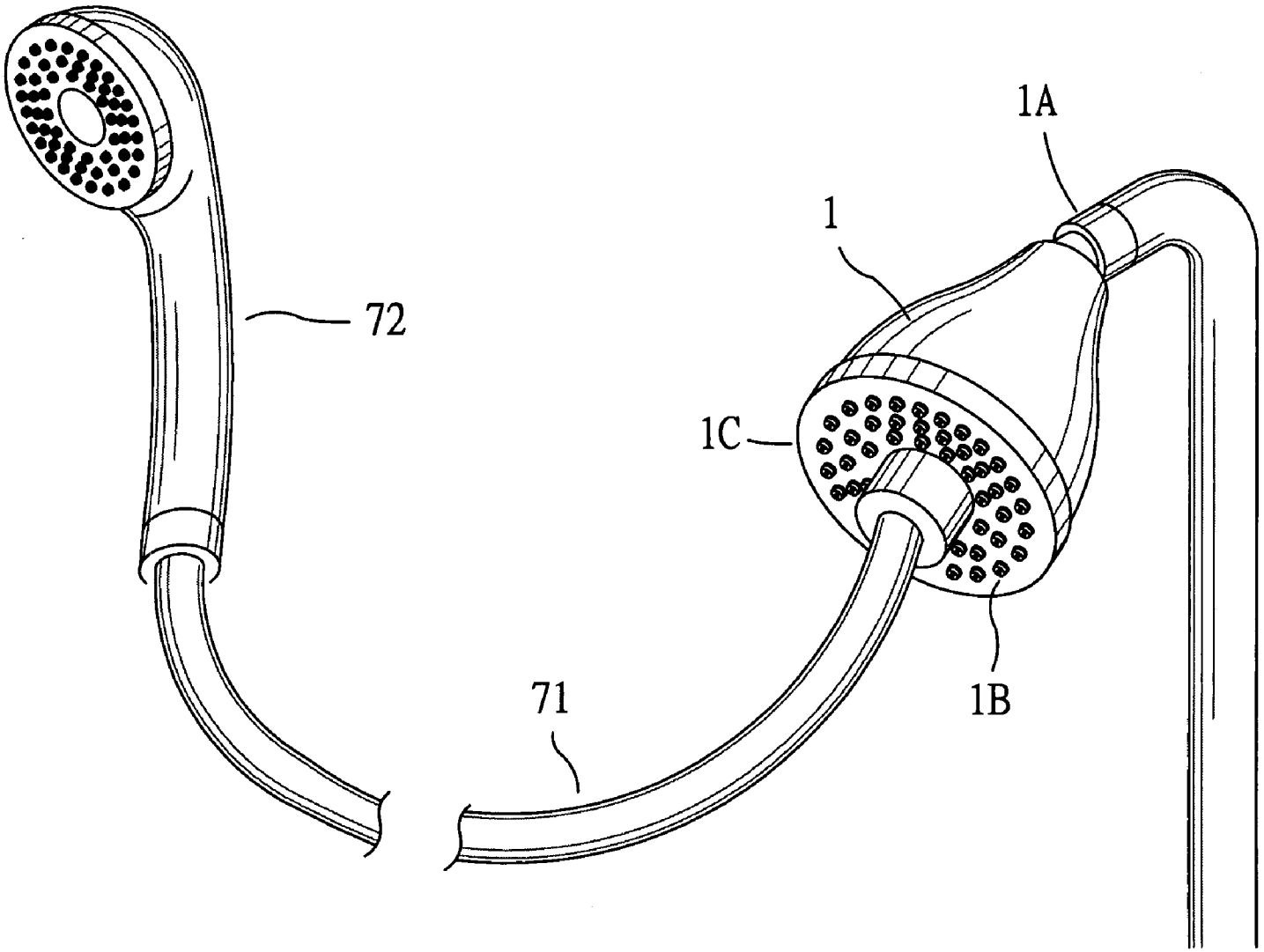
FIG. 8-B

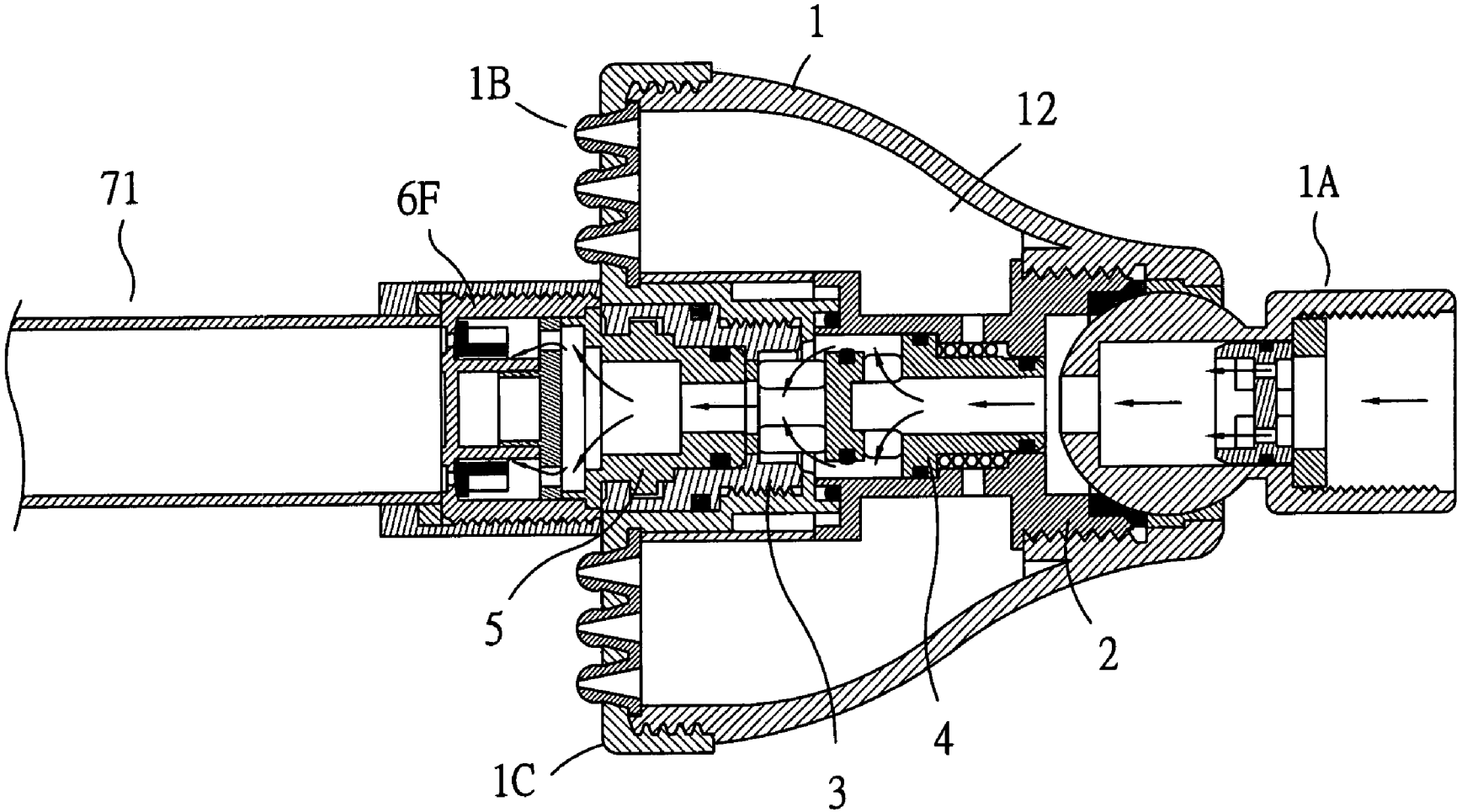
FIG. 8-C

SHOWER HEAD STRUCTURE

BACKGROUND OF THE INVENTION

1. Field of the Invention

This invention relates to a shower head structure, and more particularly to a shower head structure that can be used together with different accessories, and the shower head structure includes a shower head body having a joint base, a water stopper body, a water outlet disc, and a water stopper. The pressure of water flowing into the shower head body presses the front end of the water stopper onto a water gasket at a hollow hole of the water stopper body, so that the water is stopped from the middle of a front cover disc, but it is flowed out from the periphery of the water stopper body. If an accessory is installed, the water is stopped from the periphery of the front cover disc, and the water is supplied to the accessory through the middle of the front cover disc to provide a variety of splashes.

2. Description of the Related Art

In general, the splashes of a prior art shower head are changed by rotating or adjusting the position of a water outlet disc of the shower head, so as to produce a variety of splashes. Such arrangement does not provide an application of the shower head to be used with other accessories, and thus a special shower head is required to replace the original shower head to achieve the desired effect.

SUMMARY OF THE INVENTION

In view of the foregoing shortcomings of the prior art, the inventor of the present invention based on years of experience to conduct extensive researches and experiments, and finally invented a shower head structure in accordance with the present invention.

Therefore it is a primary objective of this invention to provide a shower head structure that can be used with other accessories, and the shower head structure comprises a front cover disc, a water outlet disc, a joint base, a water stopper body, and a water stopper. With the installation of various different accessories, the shower head structure can produce a variety of splashes.

Another objective of the present invention is to provide a shower head structure that can be used with other accessories, and the water stopper body installed in the water outlet disc of the shower head body is a hollow hole and the water stopper body includes a water gasket having a diameter slightly smaller than the hollow hole and disposed at a rear section, and the surface of the rear section is an external screw thread section, and two corresponding L-shape grooves are disposed at the front section. A plurality of guiding holes are disposed on the circumferential surface of the water stopper and interconnected with the flowing hole at the center, and a protruded gasket is disposed at the rear end, such that the external screw thread section of the water stopper body is screwed with the internal screw thread at the rear end of the water outlet disc, and the water stopper is installed into the hollow hole of the water stopper body, and a spring coil is installed in a passage of the protruded gasket and the joint base of the water stopper. If water flows into the shower head body, the water pressure pushes the water stopper forward to attach to the water gasket at the hollow hole of the water stopper body to stop water flowing out from the middle of the front cover disc, and the water flows from the flowing hole adjacent to the passage of the joint base into the internal space of the shower head body, and comes out from the periphery of the front cover disc instead.

If an accessory is installed to the shower head body, the water stopper is pushed to interconnect the passage, and the flowing hole adjacent to the passage of the joint base is blocked, so that the water will not come out from the periphery of the front cover disc, but the water will be supplied to the accessory from the middle of the front cover disc to produce a variety of splashes.

A further objective of the present invention is to provide a shower head structure that can be used with other accessories, and various accessories installed to the water stopper body in the water outlet disc is fixed and positioned by a protruded latching section of the external surface of a sheathing base and a L-shape groove disposed at the hollow hole in the front section of the water stopper body.

BRIEF DESCRIPTION OF THE DRAWINGS

FIG. 3A is a perspective view of the structure connecting a first accessory according to the present invention;

FIG. 3B is a cross-sectional view of the structure connecting a first accessory according to the present invention;

FIG. 4A is a perspective view of the structure connecting a second accessory according to the present invention;

FIG. 4B is a cross-sectional view of the structure connecting a second accessory according to the present invention;

FIG. 5A is a perspective view of the structure connecting a third accessory according to the present invention;

FIG. 5B is a cross-sectional view of the structure connecting a third accessory according to the present invention;

FIG. 6A is a perspective view of the structure connecting a fourth accessory according to the present invention;

FIG. 6B is a cross-sectional view of the structure connecting a fourth accessory according to the present invention;

FIG. 7A is a perspective view of the structure connecting a fifth accessory according to the present invention;

FIG. 7B is a cross-sectional view of the structure connecting a fifth accessory according to the present invention;

FIG. 8A is a perspective view of the structure of connecting a sixth accessory according to the present invention;

FIG. 8B is another perspective view of the structure of connecting a sixth accessory according to the present invention; and FIG. 8C is a cross-sectional view of the structure of connecting a sixth accessory according to the present invention.

DETAILED DESCRIPTION OF THE PREFERRED EMBODIMENTS

The structural assembly, technical measures, and functions of the present invention will become apparent in the following detailed description of the preferred embodiments with reference to the accompanying drawings.

Figure 1:
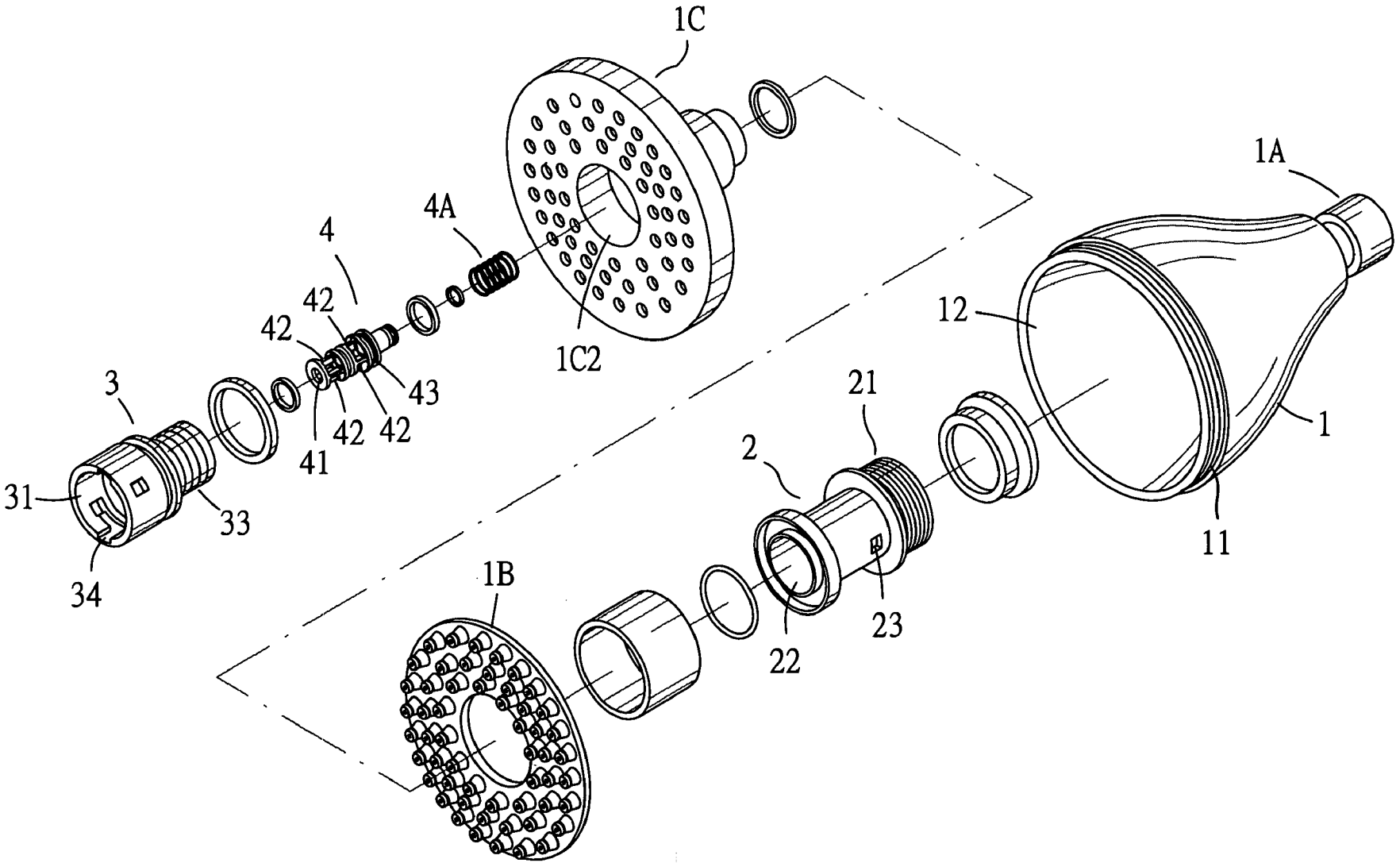
FIG. 1 is an exploded view of the structure of the present invention.
Figure 2:
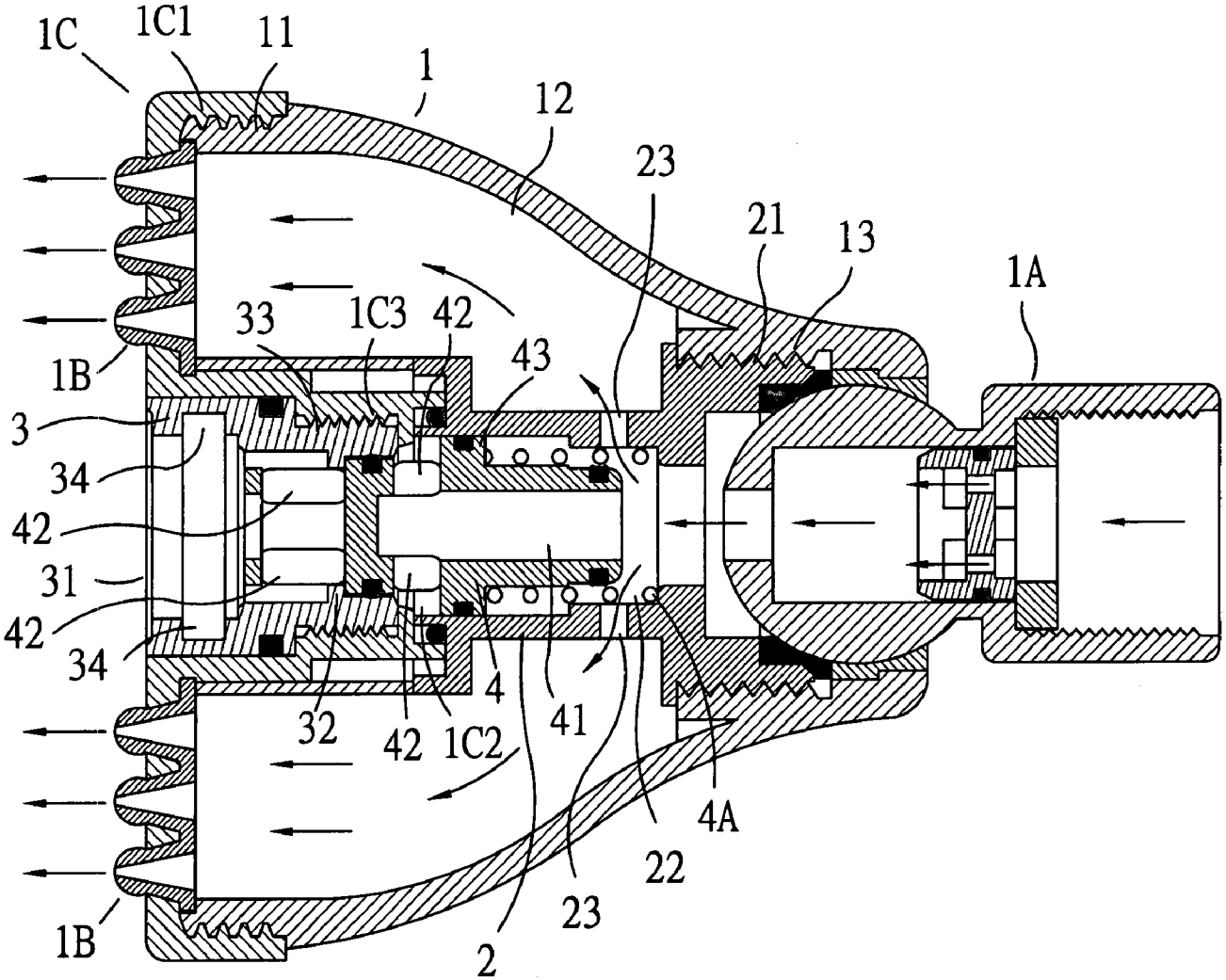
FIG. 2 is a cross-sectional view of the structure of the present invention.

Referring to FIG. 1, the shower head structure that can be used with other accessories in accordance with the present invention comprises a shower head body 1, a front cover disc 1B, a water outlet disc 1C, a joint base 2, a water stopper body 3, a water stopper 4, and a spring coil 4A. If the front cover disc 1B and the water outlet disc 1C are installed to the shower head body 1, the screw thread 1C1 at the periphery of the water outlet disc 1C and the screw thread 11 at the periphery of the shower head body 1 are screwed with each other, and a depressed hollow hole 1C2 in the water outlet disc 1C is provided for installing a joint base 2, a water stopper body 3, a water stopper 4 and a spring coil 4A. An internal screw thread 13 is disposed at the internal periphery of the internal space 12 of the shower head body 1 for integrally connecting the external screw thread 21 of the joint base 2, and a ball joint 1A is connected to the exterior of the internal screw thread 13. The joint base 2 includes a hollow passage 22 in the middle, and a flowing hole 23 is disposed at the periphery of the passage 22 for interconnecting with the internal space 12 of the shower head body 1. The water stopper body 3 is a hollow hole 31 and has a water gasket 32 having a diameter slightly smaller than the hollow hole and disposed at a rear end, and the surface of the rear end is an external screw thread section 33, and two L-shape grooves. 34 are disposed at the corresponding positions in the front section. A plurality of guiding holes 41 is disposed on the circumferential surface of the water stopper 4 and interconnected with the flowing hole 42 at the center, and the rear end includes a protruded gasket 43, such that the external screw thread section 33 of the water stopper body 3 is screwed with the internal screw thread 1C3 at the rear end of the hollow hole 1C2 of the water outlet disc 1C, and the water stopper 4 is installed into the hollow hole 31 of the water stopper body 3 and limited by placing the spring coil 4A into the passage 22 of the protruded gasket 43 and the joint base 2 at the rear end of the water stopper 4, so that the resilience of the spring coil 4A is exerted on the water stopper 4 to attach the front end of the water stopper 4 onto the water gasket 32 at the hollow hole 31 of the water stopper body 3 as shown in FIG. 2.

After the assembling procedure is completed, the water can flow into the shower head body 1. The water pressure and the resilience of the spring coil 4A push the water stopper 4 forward to be attached onto the water gasket 32 at the hollow hole 31 of the water stopper body 3, so as to block the hollow hole 1C2 of the front cover disc 1C, but the water flows towards the central position of the joint base 2 and enters from the flowing hole 23 adjacent to the passage 22 into the internal space 12 of the shower head body 1 and comes out from the periphery of the front cover disc 1B in the water outlet disc 1C as shown in FIG. 2.

If a first accessory 6 is installed to the shower head body 1, two corresponding protruded latching sections 51 of another sheathing base 5 are embedded and fixed into the L-shape grooves 34 at the front end of the water stopper body 3 as shown in FIGS. 3A and 3B. In the meantime, the water stopper 4 is pushed backward to interconnect the hollow hole 31 of the water stopper body 3, the flowing hole 42 and the guiding hole 41 of the water stopper 4, the passage 22 at the central position of the joint base 2, and the ball joint 1A and block the flowing hole 23 adjacent to the passage 22 at the central position of the joint base 2 as shown in FIG. 3B, so as to stop water coming out from the periphery of the front cover disc 1B. The water will be supplied to the first accessory 6A from the middle to produce a variety of splashes.

Similarly, if a second accessory 6B is installed to the shower head body 1, two corresponding protruded latching sections 51 of the sheathing base 5 are embedded and fixed into the L-shape grooves 34 at the front section of the water stopper body 3 as shown in FIGS. 4A and 4B, so as to push the water stopper 4 backward to interconnect the hollow hole 31, flowing hole 42, guiding hole 41, passage 22, and ball joint 1A to block the flowing hole 23 adjacent to the passage 22 as shown in FIG. 5B and stop water coming out from the periphery of the front cover disc 1B. The water will be supplied to the accessory from the middle to achieve the effect of producing a variety of splashes and using water.

If a third accessory 6C is installed to the shower head body 1 as shown in FIGS. 5A and 5B, the water stopper 4 is pushed backward to interconnect the hollow hole 31, flowing hole 42, guiding hole 41, passage 22, and ball joint 1A and block the flowing hole 23 adjacent to the passage 22 to stop water coming out from the periphery of the front cover disc 1B. The water will be supplied to the accessory from the middle to achieve the effects of producing the expected splashes and using water. If a fourth accessory 6D is installed to the shower head body 1 as shown in FIGS. 6A and 6B or a fifth accessory 6E is installed to the shower head body 1 as shown in FIGS. 7A and 7B, the sheathing base 5 will be embedded and coupled similarly to produce the expected splashes and use the water.

Further, a screw thread 6F1 and a soft tube 71 of a sixth accessory 6F are screwed with the shower head handle72 as shown in FIGS. 8A, 8B, and 8C to flexibly use various different accessories.

In summation of the above description, the present invention herein enhances the performance over the conventional structure and further complies with the patent application requirements and is submitted to the Patent and Trademark Office for review and granting of the commensurate patent rights.

What is claimed is:

1. A shower head that can be used together with different accessories, comprising a shower head body, a front cover disc, a water outlet disc, a joint base, a water stopper body, a water stopper, and a spring coil; wherein when said front cover disc and said water outlet disc are installed to said shower head body, a screw thread at the periphery of said water outlet disc is screwed with a screw thread at the periphery of said shower head body, and said water outlet disc includes a depressed hollow hole for coupling a joint base, a water stopper body, a water stopper, and a spring coil; said shower head body includes an internal screw thread disposed at the internal periphery of an internal space and integrally coupled to an external screw thread of said joint base, and said internal screw thread is coupled to a ball joint; said joint base includes a hollow passage disposed at a central position of said joint base, and said passage includes a flowing hole disposed at the periphery of said passage and interconnected with said internal space of said shower head body; and said water stopper body is substantially a hollow hole and includes a water gasket having a diameter slightly smaller than said hollow hole and disposed at a position in a rear section, and the surface of said rear section is an external screw thread section, and two corresponding L-shape grooves are disposed in said front section; said water stopper includes a plurality of guiding holes disposed on the circumferential surface of said water stopper and interconnected with said flowing hole, and said rear end has a protruded gasket; said external screw thread section of said water stopper body is screwed with said internal screw thread at the rear end of said water outlet disc hollow hole, and said water stopper is installed in said hollow hole of said water stopper body, and said spring coil is installed and limited between said protruded gasket at the rear end of said water stopper and said passage of said joint base, such that when water flows into said shower head body, the pressure of water pushes said water stopper forward to be attached onto said water gasket at said hollow hole of said water stopper body to stop water from said front cover disc, but the water flows out from said flowing hole adjacent to said passage of said joint base passage into said internal space of said shower head body, and then the water flows out from the periphery of said front cover disc; and if an accessory is installed to said shower head body, said water stopper is pushed to interconnect said passage, and said flowing hole adjacent to said passage of said joint base passage is blocked to stop water coming out from the periphery of said front cover disc, and the water is supplied to said accessory from the middle to produce a variety of splashes.

2. The shower head structure that can be used together with other accessories of claim 1, wherein said each accessory situated at said water stopper body of said water outlet disc is positioned by fixing a protruded latching section at the external surface of a sheathing base with said L-shape groove disposed at front section of said hollow hole of said water stopper body.

* * * * *